US006700316B2

(12) United States Patent
Taniuchi et al.

(10) Patent No.: US 6,700,316 B2
(45) Date of Patent: Mar. 2, 2004

(54) PROJECTOR TYPE LAMP

(75) Inventors: Hitoshi Taniuchi, Tokyo (JP); Teruo Koike, Kanagawa-ken (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 10/103,564

(22) Filed: Mar. 22, 2002

(65) Prior Publication Data

US 2002/0135280 A1 Sep. 26, 2002

(30) Foreign Application Priority Data

Mar. 23, 2001 (JP) ..... 2001-085090

(51) Int. Cl.[7] ..... H01J 5/16; F21V 5/00

(52) U.S. Cl. ..... 313/111; 313/113; 362/268; 362/309

(58) Field of Search ..... 313/111, 113, 313/114, 112; 362/343, 268, 257, 296, 309, 307; H01J 5/16; F21V 5/00

(56) References Cited

U.S. PATENT DOCUMENTS 4,198,182 A * 4/1980 Green ..... 409/132
4,517,630 A * 5/1985 Dieffenbach et al. ..... 362/509
5,049,177 A * 9/1991 Nakata ..... 65/93
5,098,184 A * 3/1992 van den Brandt et al. .. 353/102
5,211,465 A * 5/1993 Suzuki ..... 362/539
5,623,365 A * 4/1997 Kuba ..... 359/569
5,927,848 A * 7/1999 Natsume et al. ..... 362/496

FOREIGN PATENT DOCUMENTS

JP 2587355 10/1998
JP 2001-23419 1/2001

OTHER PUBLICATIONS

Excerpt from "JIS Handbook—Glass", published on Apr. 20, 1990, by Nihon Kikaku Kyokai. vol. F8405, pp. 570, 571, In Japanese.

* cited by examiner

*Primary Examiner*—Don Wong
*Assistant Examiner*—Trinh Vo Dinh
(74) *Attorney, Agent, or Firm*—Morgan, Lewis & Bockius LLP

(57) ABSTRACT

A projector type lamp can include a projection lens formed by combining together projection lens elements obtained by processing a plurality of projection lenses that can be substantially identical in optical axis center Z, focal length, and focal point, yet different in outer diameter. The projection lens can appear substantially rectangular when viewed in an optical axis direction. Boundary portions between the plurality of processed projection lens elements can be composed of a line connecting points of intersection between a contour line of the projection lens and a line defining a part of each unprocessed projection lens element at which thickness is substantially zero. The lens surfaces of the processed projection lens elements can be continuous with one another through stepped portions that are parallel to the optical axis of the projection lens.

20 Claims, 9 Drawing Sheets

RELATED ART

PROJECTOR TYPE LAMP

This invention claims the benefit of Japanese patent application No. 2001-85090, filed on Mar. 23, 2001, which is hereby incorporated by reference.

BACKGROUND OF THE INVENTION

1. Field of the Invention

The present invention relates to a lamp for vehicles such as headlamp, a fog lamp, or the like, and more particularly to a projector type lamp. A projector typeamp used herein can be composed of: an ellipsoidal reflector having a first focal point and a second focal point that is formed, for example, as a spheroid-of-revolution surface, or an elliptic free-curved surface; a light source arranged in the vicinity of the first focal point of the reflector; a projection lens arranged with its focal point located in a vicinity of the second focal point on which light emitted from the light source and reflected by the reflector converges; and a shade, as may be required, for controlling light distribution characteristics, arranged in the vicinity of the focal point of the projection lens.

2. Description of the Related Art

An example of a conventional projector type lamp 90 of the type mentioned above is shown in FIG. 13. The projector type lamp 90 is composed of: a reflector 91 which is formed, for example, as a spheroid-of-revolution surface having a first focal point f1 and a second focal point f2; a light source 92 arranged in the vicinity of the first focal point f1 of the reflector 91; and a projection lens 93 arranged such that a focal point f3 thereof is located in the vicinity of the second focal point f2 on which light emitted from the light source 92 and reflected by the reflector 91 converges.

Here, it is preferable to additionally employ a shade 94. Only beams of light required for producing an intended light distribution characteristic are permitted to pass above the shade 94, and unnecessary portions of light that converge on second focal point f2 are blocked thereby. This makes it possible to realize a projector type lamp 90 having appropriate light distribution characteristics such that, for example, when the shade 94 is located in the light path, a passing beam (hereafter referred to as "low beam") is turned on, and, when the shade 94 is retracted from the light path, a driving beam (hereafter referred to as "high beam") is turned on.

In the conventional projector type lamp 90, however, the light having converged on the second focal point f2 once, and which is expected to diverge radially thereafter, is condensed by the projection lens 93 to such an extent that it is projected in an illumination direction. Thus, the projected light is apt to diverge radially even after passing through the projection lens 93. This makes it difficult to satisfactorily focus light at a desired position.

Accordingly, the projector type lamp 90, though having the advantage of producing a light distribution characteristic of desired profile, particularly of forming a cut-off line of a low beam, has a limited degree of freedom in luminance distribution within the profile of the light distribution characteristic. Thus, the projector type lamp 90 cannot be suitably used as a lamp which illuminates a faraway area more brightly than a front, closer area, such as a headlamp for high-beam distribution.

Moreover, the projection lens 93 appears circular when seen from the front, and, when the projector type lamp 90 is mounted on a vehicle, only the projection lens 93 is visible.

Therefore, any lamp of this type provides similar impressions, and it is substantially impossible to render design variations according to the type of a vehicle on which the light is mounted. That is, the conventional projector type lamp 90 has a disadvantage in that it lacks design flexibility.

Further, since the heat produced by the light source 92 is considerably concentrated on the projection lens 93, a sharp temperature rise is inevitable. This necessitates the use of a glass member which is excellent in heat resistance, leading to an increase in cost and making it difficult to achieve weight reduction. These are examples of problems in the art that need to be solved.

Note that, in order to obtain the above-described illumination characteristics, namely, to illuminate a faraway area more brightly than a front area, and to increase the flexibility in design, there has been proposed a horizontally elongated projection lens. This projection lens is formed by cutting end portions in a vertical direction of the projection lens so that it appears substantially oval when viewed in a direction of an optical axis. However, such a horizontally elongated configuration cannot be realized without using an unprocessed projection lens that has a large outer diameter in terms of the need for cutting. The larger the outer diameter of a lens, the greater the thickness. This makes weight reduction very difficult.

SUMMARY OF THE INVENTION

In view of the foregoing, an object of the present invention is to provide a projector type lamp having an excellent light illumination characteristic in which a distant area is illuminated more brightly than an area closer to the lamp. The lamp can be made thin and lighter in weight, and have a shape of novel design when seen from the front, that is, offering a differentiating feature in terms of outward appearance, unlike conventional projection lenses. Another object of the present invention is to provide a projector type lamp in which it is possible to use light coming from a reflecting surface, even light which is typically not utilized when using a conventional Fresnel lens (because the light becomes glare light), thus increasing a quantity of light emitted from a vehicle lamp while also reducing weight of the lamp without causing glare light.

To attain the above objects, a projector type lamp according to the present invention can include: an ellipse group reflector having a first focal point and a second focal point; a light source arranged in a vicinity of the first focal point of the reflector; and a projection lens arranged with its focal point located in a vicinity of the second focal point on which light emitted from the light source and reflected by the reflector converges. The projection lens can be formed by combining a plurality of processed projection lens elements that are fabricated by processing a plurality of unprocessed projection lenses that are substantially identical in optical axis center and focal point yet different in outer diameter. The projection lens can have a substantially rectangular shape in a plan view as seen in an optical axis direction. Boundary portions between the plurality of processed projection lens elements in the plan view can be composed of a line connecting points of intersection between a contour line of the projection lens and a line defining part of each unprocessed projection lens at which the thickness of the lens is substantially zero as measured/viewed in the optical axis direction. (Contour lines defined as lines that define the periphery of the projection lens when viewed from the front along the optical axis.) Thereby, lens surfaces of the processed projection lens elements can be continuous with one another through stepped portions. A longitudinal section of each of the stepped portions includes a straight line substantially parallel to the optical axis in a longitudinal section of the projection lens. In other words, the stepped portions are separated from each other by a lens surface that is substantially parallel to the optical axis of the lens.

With this projector type lamp according to the invention, it is possible to obtain an excellent light illumination characteristic in which a distant area is more brightly illuminated than an area closer to the lamp. Moreover, the projection lens can be made slimmer and lighter in weight, and, unlike a conventional circular projection lens, can have a shape of novel design when seen from the front, that is, it can offer a differentiating feature in terms of outward appearance. Further, the junctions among the lens surfaces constituting the projection lens can be formed as stepped portions that are arranged substantially parallel to the optical axis Z. This arrangement makes it possible to use a portion of light coming from a reflecting surface. This portion of light has not been utilized in a conventional Fresnel lens, which has a circular arc shape as a whole, because the light becomes glare light (light directed upward towards an oncoming driver). As a result, the weight of the lens and lamp can be reduced, and a quantity of light available for lighting to be emitted from the vehicle lamp can be increased without causing glare light.

In the projector type lamp as constituted above, the line constituting at least one of the boundary portions between the plurality of processed projection lens elements may be a circular arc which has its center at a position away from the optical axis of the lamp, or a substantially straight line.

Furthermore, the processed projection lens element, located innermostly with respect to the optical axis center out of the processed projection lens elements, may be so configured that its lens surface appears as a square in a plan view when viewed in the optical axis direction.

The stepped portion between the processed projection lens elements may be colored or covered with a colored member. Thus, the appearance of the headlamp in a non-lighting state can be enhanced and made more original without having an adverse effect on the projection light color.

The short sides of the rectangle of the projection lens may be composed of parts of a circular arc or a contour line of the unprocessed projection lens located outermost. This provides an improved design flexibility.

At least one of the plurality of processed projection lens elements may be replaced by a lens whose longitudinal section has a substantially straight line on its lens surface, which line is substantially perpendicular to the optical axis. Alternatively, it may have a curve which is convex with respect to the optical axis, for providing a predetermined luminous distribution. This provides an appropriate luminous distribution, for example, a distribution in which light is diffused in right and left directions.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

These and other objects and advantages of the present invention will become clear from the following description with reference to the accompanying drawings, wherein:

FIG. 11(*b*) is a diagram for assistance in explaining a further variation of the projection lens according to the present invention;

DETAILED DESCRIPTION OF THE PREFERRED EMBODIMENTS

The present invention will be described in detail hereinafter with reference to preferred embodiments shown in the accompanying drawings.

Figure 1:
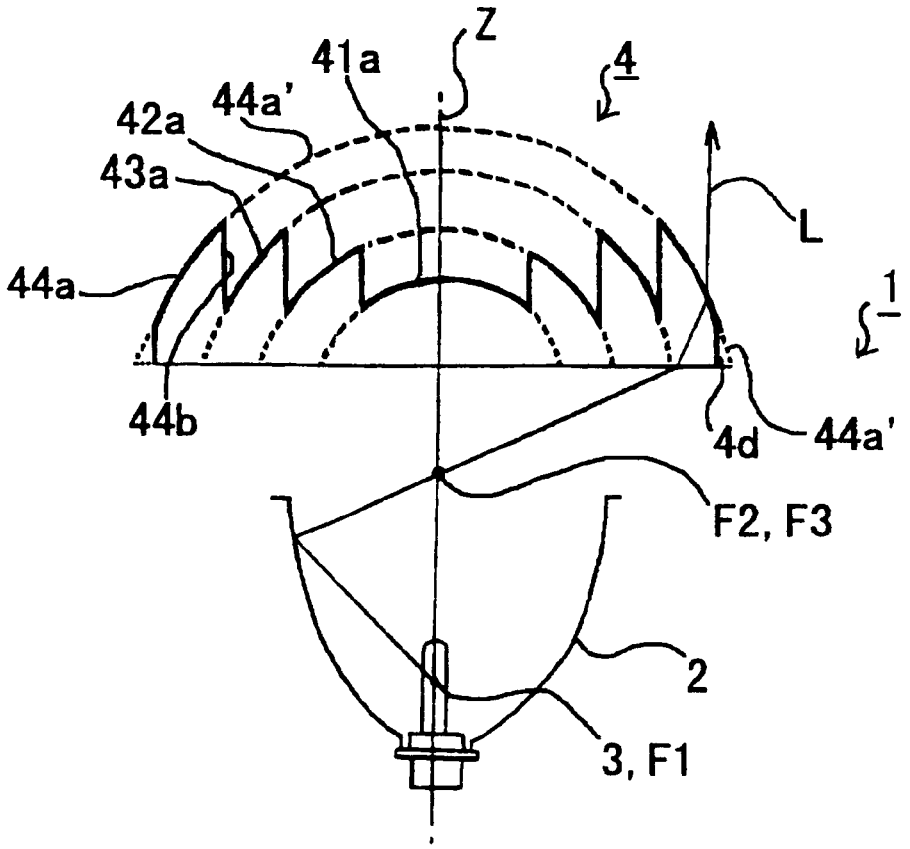
FIG. 1 is a cross-sectional view showing an embodiment of a projector type lamp according to the present invention.

FIG. 1 is a cross-sectional view showing an embodiment of a projector type lamp 1 according to the present invention. The projector type lamp 1 can be composed of a reflector 2 (for example, an ellipse group reflector) having a first focal point F1 and a second focal point F2. The reflector 2 can be formed, for example, as a spheroid-of-revolution surface. A light source 3, such as a halogen bulb or metal halide lamp, can be arranged in the vicinity of the first focal point F1 of the reflector 2. A projection lens 4 can be arranged such that a focal point F3 thereof is located in the vicinity of the second focal point F2 on which light emitted from the light source 3 and reflected by the reflector 2 converges. Further, a shade (not shown) for controlling light distribution characteristics can be arranged in the vicinity of the focal point F3 of the projection lens 4, as circumstances require.

Figure 2:
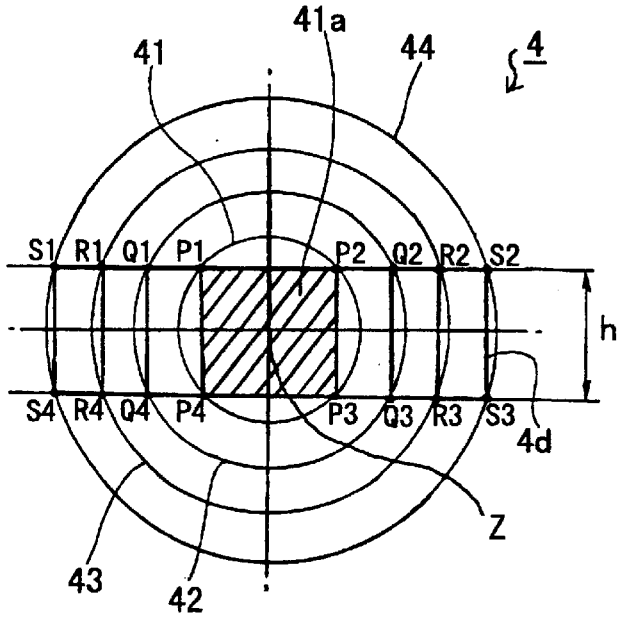
FIG. 2 is a diagram for assistance in explaining the procedure for fabricating a projection lens in accordance with principles of the invention.

An ellipse group reflector can be defined as a reflector having a curved surface having an ellipse or its similar shape as a whole, such as a rotated elliptic surface, a complex elliptic surface, an ellipsoidal surface, an elliptic cylindrical surface, an elliptical free-curved surface, or combination thereof According to the present invention, the projector type lamp 1 is characterized in that the projection lens 4 is formed by combining together portions of a plurality of projection lenses that are substantially identical in optical axis center Z and focal point, yet different in outer diameter (hereinafter referred to as "unprocessed projection lenses"), and the entire projection lens 4 appears substantially rectangular when viewed in a direction of the optical axis Z. One example of procedures for fabricating such a projection lens will be described below with reference to FIG. 2. That is, as depicted in FIG. 2, four pieces of unprocessed projection lens 41, 42, 43, and 44 are substantially identical in optical axis center Z, focal length, and focal point yet different in outer diameter. In this case, they are processed into processed projection lens pieces 41, 42, 43, and 44 (hereinafter referred to "processed projection lens pieces") and the processed pieces are combined together to form a single projection lens 4 having a substantially rectangular configuration as a whole. It should be noted that lines representing the contour of the rectangle of the projection lens according to the invention are referred to as "contour lines." The projection lenses before and after processing are denoted by the same reference numeral herein for the sake of convenience.

The first unprocessed projection lens 41, located innermostly with respect to the optical axis Z (hereinafter called "optical axis center Z"), is preferably sectioned horizontally (viewing the drawing) along a line P1–P2 and a line P3–P4 (they correspond to parts of the contour lines of the long sides of the projection lens 4) so as to leave a given dimension (h) (corresponding to the length of the short side of the rectangle), and then sectioned vertically along a line P1–P4 and a line P2–P3 so as not to leave any circumferential portion. In this way, the first processed projection lens element 41, located innermostly with respect to the optical axis center Z, is so configured that its lens surface 41*a* has a substantially rectangular shape defined by the line P1–P2–P3–P4, as viewed from the front (in the optical axis Z direction). The first processed projection lens element 41 can be used as a reference lens. Note that, in the illustrative example, the lens surface 41*a* is given a square shape to make the most of the entire area of the projection lens element 41. However, lens surface 41 could be configured in different shapes.

Next, the second unprocessed projection lens 42, i.e. the second-innermost lens with respect to the optical axis center Z, is preferably hollowed out so as to receive the first processed projection lens element 41. Then, intersections Q1, Q2, Q3, and Q4 are determined, of which Q1 and Q2 are preferably points of intersection between the extension line of the upper cutting line P1–P2 of the first processed projection lens element 41 (a part of the contour line of the long side of the projection lens 4) with the circumference of the second unprocessed projection lens 42 at which thickness as taken along the optical axis is substantially zero. Q3 and Q4 are preferably points of intersection between the extension line of the lower cutting line P3–P4 and the same circumference. Subsequently, like the first processed projection lens element 41, the unprocessed second projection lens 42 can be sectioned horizontally along a line Q1–Q2 and a line Q3–Q4 so as to leave the given dimension (h), and then sectioned vertically along a line Q1–Q4 and a line Q2–Q3 so as not to leave any circumferential portion.

The third unprocessed projection lens 43, i.e. the third-innermost lens with respect to the optical axis center Z, can be hollowed out so as to receive the second processed projection lens element 42. Then, intersections R1, R2, R3, and R4 are determined, of which R1 and R2 are preferably points of intersection between the extension line of the upper cutting line Q1–Q2 of the second processed projection lens element 42 (a part of the contour line of the long side of the projection lens 4) with the circumference of the third unprocessed projection lens 43 at which thickness as taken along the optical axis is substantially zero. R3 and R4 are preferably points of intersection between the extension line of the lower cutting line Q3–Q4 and the same circumference. Subsequently, like the first and second processed projection lens elements 41 and 42, the third unprocessed projection lens 43 can be sectioned horizontally along a line R1–R2 and a line R3–R4 so as to leave the given dimension (h), and then sectioned vertically along a line R1–R4 and a line R2–R3 so as not to leave any circumferential portion.

Lastly, the fourth unprocessed projection lens 44, located outermost with respect to the optical axis center Z, is preferably hollowed out so as to receive the third processed projection lens element 43. Then, intersections S1, S2, S3, and S4 are determined, of which S1 and S2 are preferably points of intersection between the extension line of the upper cutting line R1–R2 of the third processed projection lens element 43 (a part of the contour line of the long side of the projection lens 4) with the circumference of the fourth unprocessed projection lens 44 at which thickness as taken along the optical axis is substantially zero. S3 and S4 are preferably points of intersection between the extension line of the lower cutting line R3–R4 and the same circumference. Subsequently, like the first, second, and third processed projection lens elements 41, 42, and 43, the fourth unprocessed projection lens 44 is preferably sectioned horizontally along a line S1–S2 and a line S3–S4 so as to leave the given dimension (h), and then sectioned vertically along a line S1–S4 and a line S2–S3 so as not to leave any circumferential portion.

In this way, the four processed projection lens elements 41, 42, 43, and 44 that are substantially identical in optical axis center Z and focal point yet different in outer dimension are combined together. The resulting projection lens 4 appears substantially rectangular when viewed in the optical axis Z direction (from the front).

Figure 3:
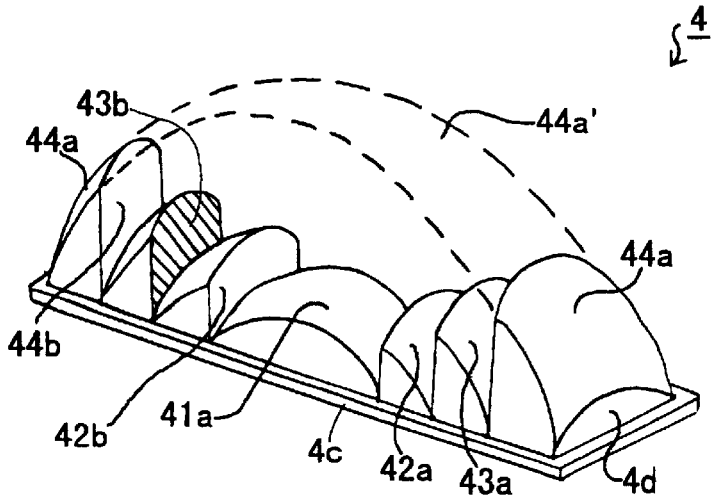
FIG. 3 is a perspective view of the embodiment of the projection lens of FIG. 1.
Figure 12:
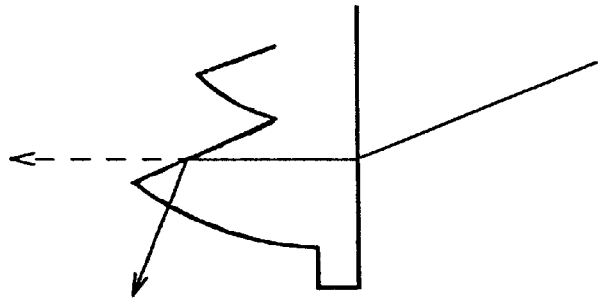
FIG. 12 is a vertical sectional view showing an optical path as observed in a conventional Fresnel lens.
Figure 13:
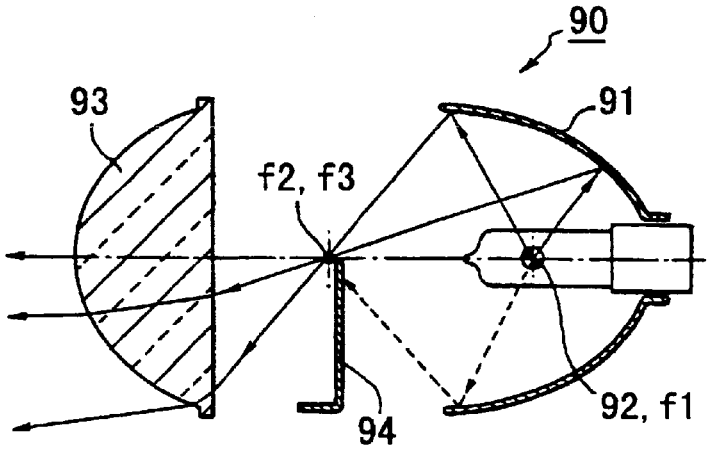
RELATED ART Fig.13
FIG. 13 is a vertical sectional view showing a conventional vehicle lamp.

FIG. 3 is a perspective view illustrating the entire projection lens 4. Lens surfaces 41*a*, 42*a*, 43*a*, and 44*a* of the processed projection lens elements 41, 42, 43, and 44 are preferably continuous with one another through stepped portions 42*b*, 43*b*, and 44*b* that are arranged substantially parallel to the optical axis Z. Note that, a face including points where the surface of the processed projection lens pieces are substantially zero in thickness can be placed on a transparent plate having an appropriate thickness. In the thus constructed projection lens a flange 4*c* is provided in the vicinity of the contour of the plate. In this figure, dotted lines indicate a virtual lens surface 44*a*' which is obtained in a case where the projection lens 4 is composed solely of the unprocessed projection lens 44 located outermost with respect to the optical axis center Z. As compared with this, the projection lens 4 of the embodiment according to the present invention is made slimmer and lighter in weight in its entirety. Moreover, the projection lens 4, unlike a conventional circular projection lens, assumes a shape of novel design when seen from the front, that is, offers a differentiating feature in terms of outward appearance. Further, the junctions among the lens surfaces 41*a*, 42*a*, 43*a*, and 44*a* are formed as stepped portions that are arranged substantially parallel to the optical axis Z. Therefore, it is possible to use light coming from a portion of the reflecting surface 2, which has never been utilized in a conventional Fresnel lens having a circular arc shape as a whole, as shown in FIG. 12. It is also possible to reduce the weight of the lens, and to increase a quantity of light available for emitting from a vehicle lamp 1.

Figure 4:
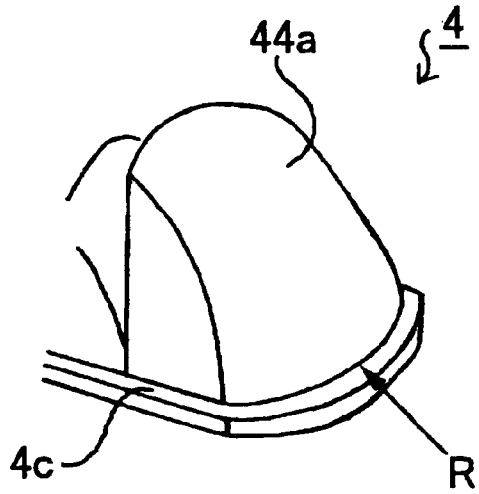
FIG. 4 is a perspective view showing a portion of another embodiment of the projection lens.
Figure 5:
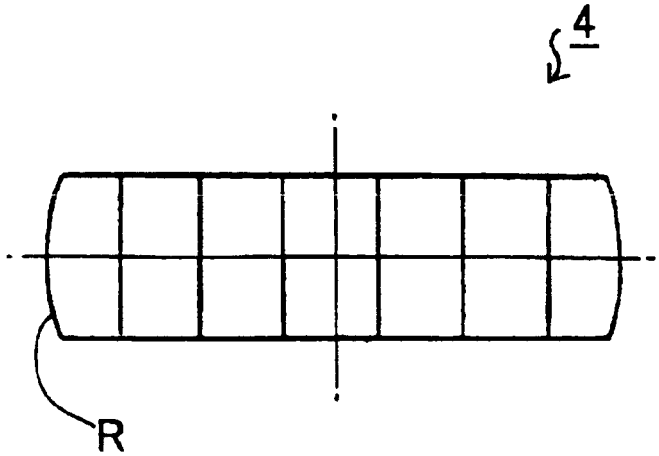
FIG. 5 is a front view of the embodiment of the projection lens of FIG. 4.

Although the processed projection lens element 44, located outermost with respect to the optical axis center Z, is sectioned vertically along the lines S1–S4 and S2–S3 so as to create a sectioned surface 4*d* (at the short sides of the rectangle), it may also be so designed that, as shown in FIG. 4, a circular arc shape R, which constitutes part of the contour of the unprocessed projection lens 44, is left intact instead of creating the sectioned surface 4*d* (i.e., without being sectioned along the lines S1–S4 and S2–S3). In this case, as shown in FIG. 5, the entire projection lens 4 appears substantially rectangular when viewed in the optical axis Z direction (from the front), and parts of the contour of the unprocessed lens 44 form the pair of short sides of the rectangle.

Figure 6:
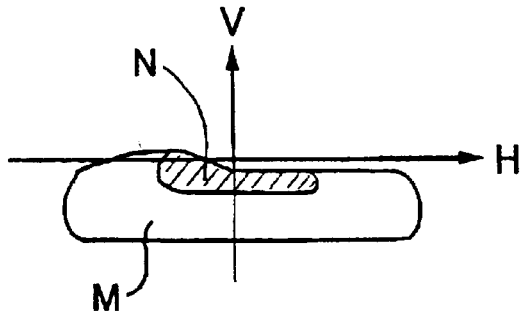
FIG. 6 is a view showing a light distribution pattern of the projector type lamp according to the present invention.

FIG. 6 shows a light distribution pattern of the projector type lamp 1 employing the projection lens 4 thus constructed. A light distribution pattern portion N is formed by the light having passed through the outermost lens surface 44*a*, and a light distribution pattern M is formed by the light having passed through the inner lens surfaces 41*a*, 42*a*, and 43*a*. In general, light having passed through the outer lens portions of the projection lens 4 tends to converge centrally. In light of this, by properly adjusting the number and shape of the processed projection lens elements 42, 43, and 44, it is possible to obtain a horizontally elongated light illumination characteristic in which a faraway area is illuminated more brightly than a front area, which is useful in a headlamp for vehicles. It should be noted that, although FIG. 6 shows a low beam light distribution pattern, in a case where a shade is retracted from an optical path traveling from the light source to the projection lens, a high beam light distribution pattern can be obtained.

Figure 7:
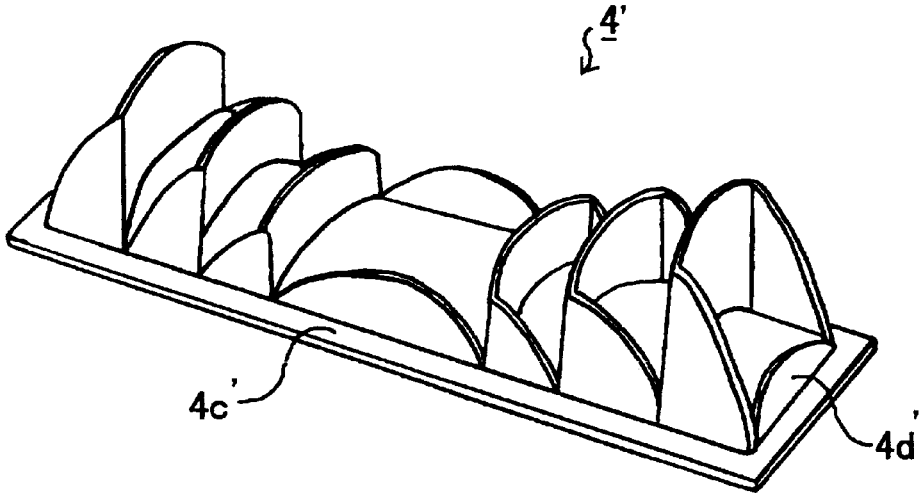
FIG. 7 is a perspective view showing a colored member.

In a case where the projection lens 4 is mounted laterally on a vehicle body, although some light emitted from the light source 3 is incident on the stepped portions 42*b*, 43*b*, and 44*b* of the processed projection lens elements 41, 42, 43, and 44, such incident light is not effective light for illumination. Thus, by applying colors to those portions, the appearance of the headlamp in a non-lighting state can be made more novel without having an adverse effect on the projection light color. Moreover, it is also possible, as shown in FIG. 7, to cover the projection lens 4 with a colored member 4' for connecting or covering the stepped portions 42*b*, 43*b*, and 44*b*. The cover 4' can include side portions such as side portion 4*d*' that cover the outer surface of the lens 4, and can include cover portion 4*c*' that covers the flange 4*c*.

Figure 8:
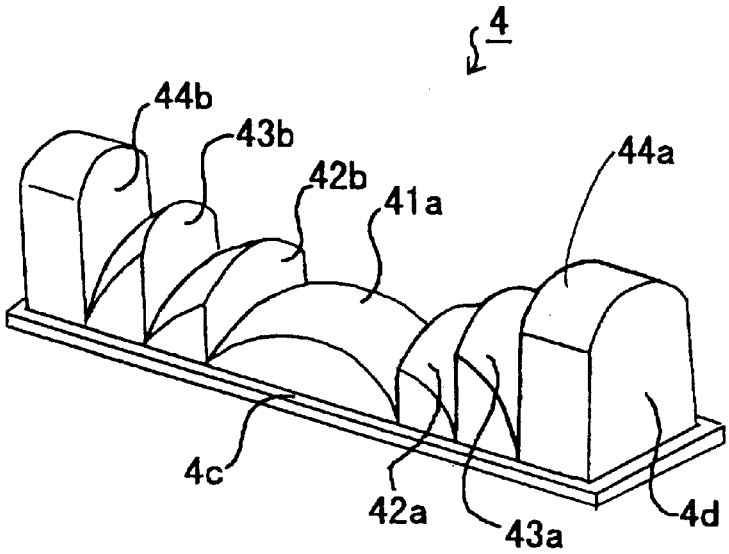
FIGS. 8(*a*) and 8(*b*) are perspective views of additional embodiments of the projection lens.

Further, although the above explanation has been given as to the shape of the projection lens 4 intended for improving the distant visibility, the projection lens 4 may be so designed as to obtain laterally diffused light distribution. In this case, as shown in FIGS. 8(*a*) and 9(*a*), the outermost processed projection lens element 44 is replaced by a processed lens which has a lens surface 44*a* whose longitudinal sectional profile shows a straight line which is substantially perpendicular to the optical axis Z. In this configuration, parallel light L shown in FIG. 1 (corresponding to the light distribution portion N hatched in FIG. 6), which is emitted from the lens surface 44*a* of the processed projection lens element 44, is allowed to diffuse laterally as light L' shown in FIG. 9(*a*). For example, in order for the low beam light distribution pattern to be wider horizontally, the basic profile of the light distribution pattern is formed by the lens surface 41*a*. Then, the luminance of a predetermined portion within the light distribution pattern is increased by the lens surfaces 42*a* and 43*a*. The lens surface 44*a* may be so designed as to illuminate outside the basic profile of the light distribution pattern, or to illuminate a predetermined portion within the light distribution pattern.

FIG. 8(*b*) shows the outermost processed projection lens element 44 replaced by a processed lens which has a lens surface 44*a* whose longitudinal sectional profile is a curve that is convex in relationship to the illuminating direction of the projection lens. In this configuration, parallel light L shown in FIG. 1 (corresponding to the light distribution portion N hatched in FIG. 6), which is emitted from the lens surface 44*a* of the processed projection lens element 44, is allowed to diffuse in different directions.

Figure 9:
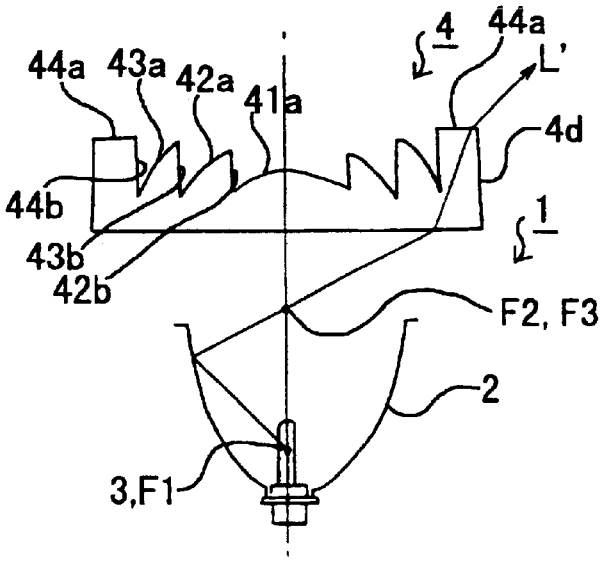
FIGS. 9(*a*) and 9(*b*) are a cross-sectional views of the embodiment of the projection lens of FIGS. 8(*a*) and (*b*), respectively.
Figure 8:
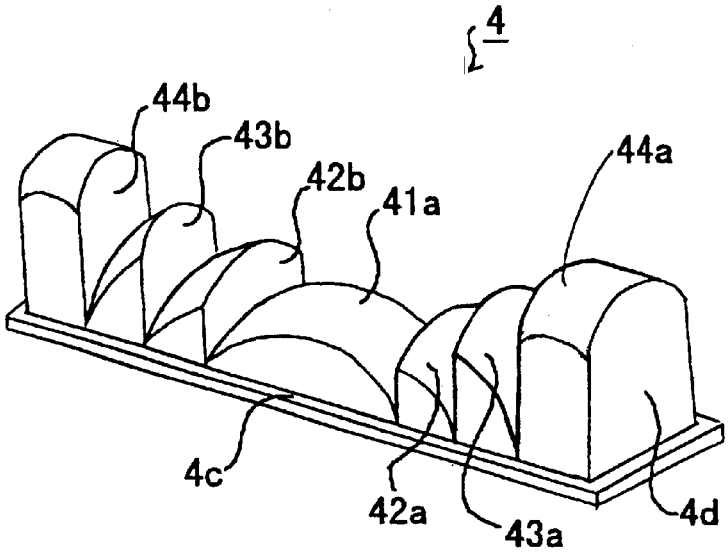
Figure 9:
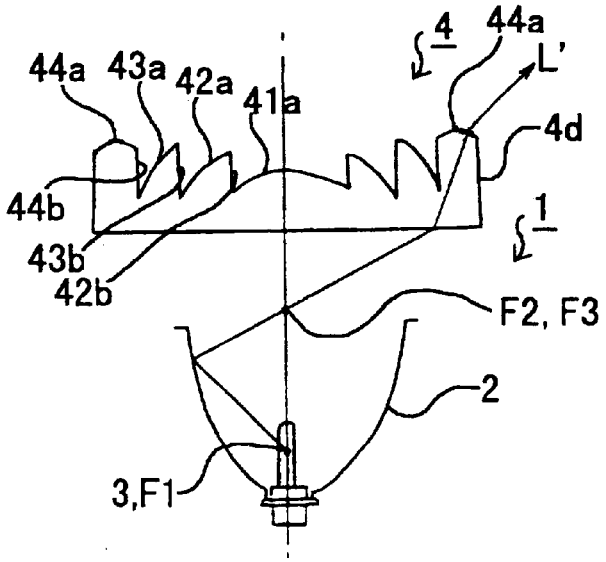

Further, while in FIG. 9(*a*), an example is shown in which only the outermost lens surface 44*a* has its longitudinal sectional profile showing a straight line which is substantially perpendicular to the optical axis Z, one or more of the lens surfaces 42*a*, 43*a*, and 44*a* may have its longitudinal sectional profile showing a straight line which is substantially perpendicular to the optical axis Z, as circumstances require. Alternatively, the outermost lens surface 44*a* may have its longitudinal sectional profile showing a circular arc which is substantially perpendicular to the optical axis Z, or one or more of the lens surfaces 42*a*, 43*a*, and 44*a* may have its longitudinal sectional profile showing a circular arc which is substantially perpendicular to the optical axis Z, as circumstances require. In addition, as shown in FIG. 9(*b*), the longitudinal sectional profile of one or more of the lens surfaces 42*a*, 43*a*, and 44*a* can be curved in a manner that it is convex along an illumination direction of the lamp, and such that one or more of the lens surfaces is convex as viewed from the front of the lamp.

Figure 10:
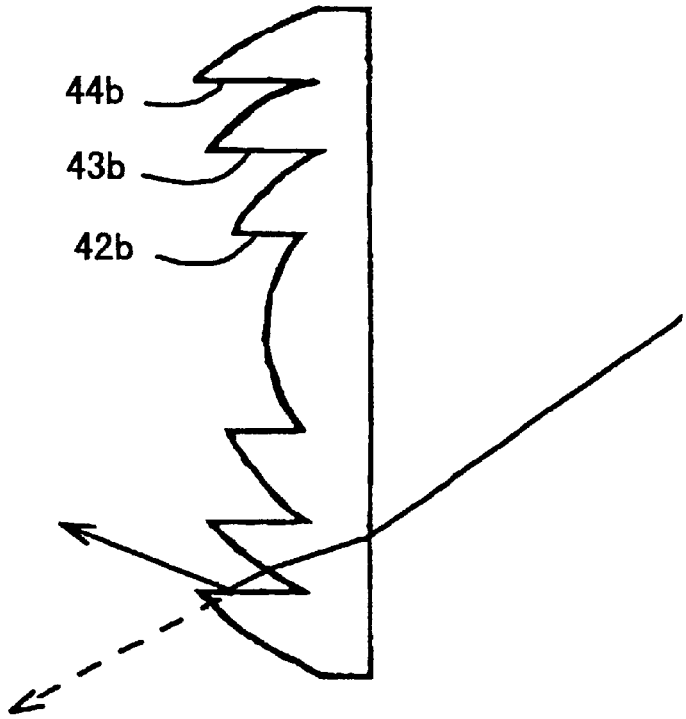
FIG. 10 is a vertical sectional view of an optical path as observed when the embodiment of the projection lens of FIG. 1 is arranged vertically.

Further, while in the above-described embodiments, the projection lens 4 is described as arranged so as to have a laterally elongated rectangular shape, it may be arranged so as to have a vertically elongated rectangular shape, depending on the light distribution pattern required. This arrangement can be achieved simply by turning the same projection lens 4 by 90 degrees. In this case, as shown in FIG. 10, the light incident on the stepped portions 42*b*, 43*b*, and 44*b* travels in an upward direction, which affects the light distribution pattern as glare. Therefore, the vertically elongated rectangular shape should preferably be adopted only for the high beam light distribution pattern, which is allowed to include upward beams.

Figure 11A:
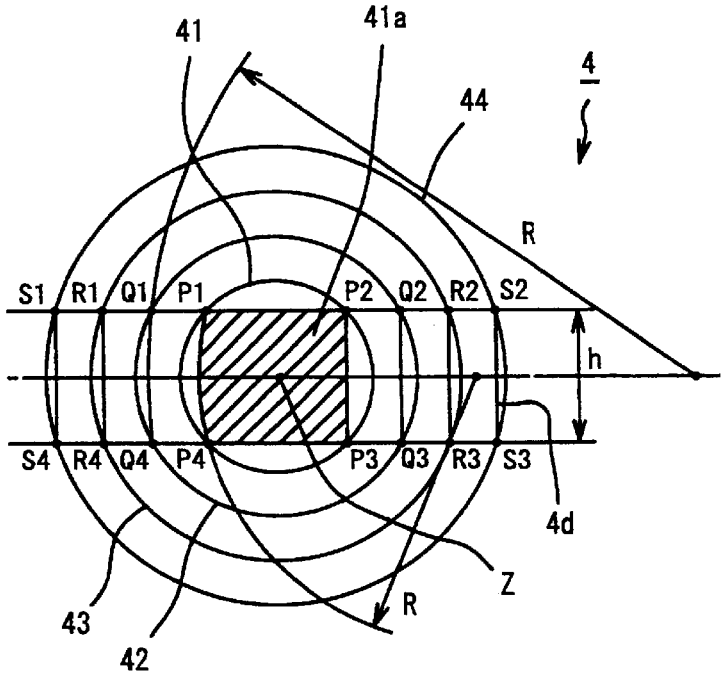
FIG. 11 (*a*) is a diagram for assistance in explaining variations of the projection lens according to the present invention.
Figure 11B:
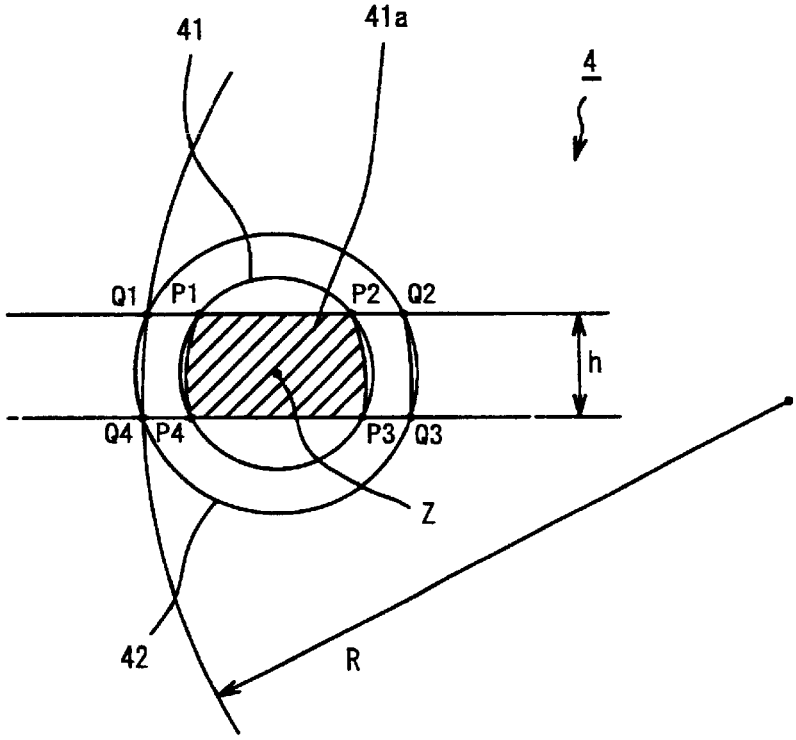

In addition, while in the above-described embodiments, the lines P1–P2, P2–P3, Q1–Q4, Q2–Q3, R1–R4, and R2–R3 are each defined by a straight line, they may be defined by a curve. So long as a plurality of projection lens elements used in combination are arranged with their centers located substantially on the same optical axis, the boundary portions (lines P1–P2, P2–P3, Q1–Q4, Q2–Q3, R1–R4, and R2–R3) can be formed in any given shape. For example, the farther the center of the circular arc constituting the boundary portion is located away from the projection lens, the more the shape of the boundary portion approaches a straight line (refer to FIGS. 11(*a*)–(*b*)).

Further, while in the above-described embodiments, the projection lens 4 is described as formed of four pieces of processed projection lens elements combined together, it may be formed by combining together two or more projection lens elements.

Note that, while in the above-described embodiments, the projection lens 4 is described as used for a vehicle lamp, the lens configuration described thus far may be suitably used for other applications, such as general lighting devices, entertainment devices, marine lights, etc.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A projector type lamp comprising:

a reflector having a first focal point and a second focal point;

a light source arranged in a vicinity of the first focal point of the reflector; and a projection lens having an optical axis and arranged with its focal point located in a vicinity of the second focal point at which light emitted from the light source and reflected by the reflector converges, the projection lens being formed by combining a plurality of processed projection lens elements that are fabricated by processing a plurality of unprocessed projection lenses substantially identical in optical axis center and focal point yet different in outer diameter, the projection lens having a substantially rectangular shape in a plan view as viewed from the optical axis, boundaries between the plurality of processed projection lens elements in the plan view as viewed from the optical axis direction being composed of a line connecting points of intersection between a contour line of the projection lens in said plan view and a line defining a part of each unprocessed projection lens at which thickness of the unprocessed projection lens is substantially zero, such that lens surfaces of the processed projection lens elements are continuous with one another through stepped portions, the stepped portions each having a surface that is substantially parallel to the optical axis of the projection lens.

2. The projector type lamp according to claim 1, wherein one of the stepped portions between the processed projection lens elements is colored.

3. The projector type lamp according to claim 1, wherein short sides of the substantially rectangular shape of the projection lens are curve shaped.

4. The projector type lamp according to claim 1, further comprising:

at least one secondary processed projection lens element whose longitudinal section has a substantially straight line on its lens surface, which straight line is substantially perpendicular to the optical axis of the projection lens.

5. The projector type lamp according to claim 1, further comprising:

at least one secondary processed projection lens element whose longitudinal section has a curved line which is convex along an illumination direction of the projector type lamp, for providing a predetermined luminous distribution.

6. The projector type lamp according to claim 1, further comprising:

a colored member located on one of the stepped portions between the processed projection elements.

7. The projector type lamp according to claim 1, wherein the reflector is an ellipse group reflector.

8. A projector type lamp comprising:

a reflector having a first focal point and a second focal point;

a light source arranged in a vicinity of the first focal point of the reflector; and a projection lens having an optical axis and arranged with its focal point located in a vicinity of the second focal point at which light emitted from the light source and reflected by the reflector converges, the projection lens being formed by combining a plurality of processed projection lens elements that are fabricated by processing a plurality of unprocessed projection lenses substantially identical in optical axis center and focal point yet different in outer diameter, the projection lens having a substantially rectangular shape in a plan view as viewed from the optical axis, boundaries between the plurality of processed projection lens elements in the plan view as viewed from the optical axis direction being composed of a line connecting points of intersection between a contour line of the projection lens in said plan view and a line defining a part of each unprocessed projection lens at which thickness of the unprocessed projection lens is substantially zero, the line constituting at least one of the boundaries between the plurality of processed projection lens elements is a circular arc which has its center at a position away from the optical axis of the lamp, such that lens surfaces of the processed projection lens elements are continuous with one another through stepped portions, the stepped portions each having a surface that is substantially parallel to the optical axis of the projection lens.

9. The projector type lamp according to claim 8, wherein the line constituting at least one of the boundaries between the plurality of processed projection lens elements is a substantially straight line.

10. The projector type lamp according to claim 9, wherein the processed projection lens element located innermostly with respect to the optical axis center out of the processed projection lens elements is so configured that its lens surface appears as square in plan view when viewed in the optical axis direction.

11. The projector type lamp according to claim 9, wherein one of the stepped portions between the processed projection lens elements is colored.

12. The projector type lamp according to claim 8, wherein the processed projection lens element located innermostly with respect to the optical axis center out of the processed projection lens elements is so configured that its lens surface appears as square in plan view when viewed in the optical axis direction.

13. The projector type lamp according to claim 8, wherein one of the stepped portions between the processed projection lens elements is colored.

14. The projector type lamp according to claim 8, further comprising:

a colored member located on one of the stepped portions between the processed projection elements.

15. A projector type lamp comprising:

a reflector having a first focal point and a second focal point;

a light source arranged in a vicinity of the first focal point of the reflector; and a projection lens having an optical axis and arranged with its focal point located in a vicinity of the second focal point at which light emitted from the light source and reflected by the reflector converges, the projection lens being formed by combining a plurality of processed projection lens elements that are fabricated by processing a plurality of unprocessed projection lenses substantially identical in optical axis center and focal point yet different in outer diameter, the processed projection lens element located innermostly with respect to the optical axis center out of the processed projection lens elements is so configured that its lens surface appears as square in plan view when viewed in the optical axis direction, the projection lens having a substantially rectangular shape in a plan view as viewed from the optical axis, boundaries between the plurality of processed projection lens elements in the plan view as viewed from the optical axis direction being composed of a line connecting points of intersection between a contour line of the projection lens in said plan view and a line defining a part of each unprocessed projection lens at which thickness of the unprocessed projection lens is substantially zero, such that lens surfaces of the processed projection lens elements are continuous with one another through stepped portions, the stepped portions each having a surface that is substantially parallel to the optical axis of the projection lens.

16. The projector type lamp according to claim 15, wherein one of the stepped portions between the processed projection lens elements is colored.

17. A projector type lamp comprising:

a reflector having a first focal point and a second focal point;

a light source arranged in a vicinity of the first focal point of the reflector; and a projection lens having an optical axis and arranged with its focal point located in a vicinity of the second focal point at which light emitted from the light source and reflected by the reflector converges, the projection lens being formed by combining a plurality of projection lens elements that are separated from each other by stepped portions, each of the projection lens elements having an identical optical axis center and an identical focal point, as well as a different respective outer diameter, each of the stepped portions having a surface that is substantially parallel to the optical axis of the projection lens.

18. The projector type lamp according to claim 17, wherein the projection lens has a substantially rectangular shape in a plan view as viewed from the optical axis.

19. The projector type lamp according to claim 17, wherein at least one of the surfaces of the stepped portions is curved.

20. The projector type lamp according to claim 17, wherein at least one of the stepped portions is colored.

* * * * *